United States Patent [19]

Nielsen

[11] 4,278,402

[45] Jul. 14, 1981

[54] ADJUSTABLE LIQUID LEVEL CONTROL FOR PUMPS

[76] Inventor: Axel L. Nielsen, 1316 Elza, Hazel Park, Mich. 48030

[21] Appl. No.: 66,187

[22] Filed: Aug. 13, 1979

[51] Int. Cl.[3] ..... F04B 49/10

[52] U.S. Cl. ..... 417/38; 417/44

[58] Field of Search ..... 417/38, 39, 41, 44, 417/36

[56] References Cited

U.S. PATENT DOCUMENTS

| | | | |
|---|---|---|---|
| 2,732,804 | 1/1956 | Sadler et al. | 417/44 X |
| 3,043,225 | 7/1962 | Nielsen | 417/44 |
| 3,502,029 | 3/1970 | Halladay | 417/44 X |
| 3,981,619 | 9/1976 | Mitter | 417/38 |

*Primary Examiner*—Harvey C. Hornsby

*Assistant Examiner*—Arthur O. Henderson

*Attorney, Agent, or Firm*—Whittemore, Hulbert & Belknap

[57] ABSTRACT

A pressure responsive pumping system comprising a motor driven impeller pump, a pressure responsive switch controlling the pump motor, and a pressure-sensing device comprising a tube extending through a side wall of the pump casing and slidable substantially radially thereof, a port adjacent the inner end of the tube, and a conduit connecting the outer end of the tube to the switch. More specifically an impeller pump having a flat end wall, an opening in its peripheral wall, a channel at the inner side of the end wall in alignment with the opening, and a tube slidable longitudinally through the opening and along said groove having a port at its inner open end, or at a side thereof adjacent its inner closed end.

14 Claims, 8 Drawing Figures

ADJUSTABLE LIQUID LEVEL CONTROL FOR PUMPS

REFERENCE TO PRIOR ART

The present invention is an improvement over my prior U.S. Pat. No. 3,043,225, granted July 10, 1962.

BACKGROUND AND SUMMARY OF THE INVENTION

My prior patent discloses a centrifugal pump having a rotor, an inlet at the center of the rotor casing, and an outlet disposed at the outer periphery of the casing. In a pump of this type, pressure within the casing varies from a minimum or negative pressure at the intake eye to a maximum at the outer wall of the casing where the outlet or discharge opening is provided.

The patent disclosed means for sensing a pressure within the pump casing during operaton of the pump, and this means included a rotary plug of circular cross-section provided in the top wall of the casing having a port located eccentrically at the inner wall of the plug, so that upon rotary adjustment of the plug, the port can be adjusted radially of the casing.

In my prior patent there is disclosed a pumping system control which was designed primarily for use in discharging water from a laundry tub. The patent indicates that the pump control disclosed therein was capable of general application. In fact, since the pump control system has been in commercial production, its field of use has greatly expanded. It is now being used to evacuate water from basements, bar sinks, waste water from beauty parlors, water coolers, sauna baths, and in office buildings where individual hand wash sinks are used, and many others.

In some of its applications, such as in the case of the hand wash sinks, special problems are presented. For example in this case, as in others, the head is sometimes high and the distance to the nearest outlet is long, and it is necessary to sense the pressure within the pump at a point closely adjacent the pump intake eye, which is not possible with the angularly adjustable plug.

In other applications, such as where a low head exists, it is desirable to sense the pressure closely adjacent the periphery of the casing, at a point not possible with the angularly adjustable plug.

Accordingly the use of the angularly adjustable plug with the eccentric pressure sensing port does not afford sufficient adjusting limits to include the extreme limits required by the new uses to which the pump is applied.

There are limitations to the shape and configuration of a centrifugal pump housing in order that the pump design remains practical and efficient, and these preclude simply increasing the diameter of the eccentric plug so that its pressure sensing port may be adjusted through a range determined by its location from closely adjacent the eye of the pump at its intake to a point closely adjacent the outer periphery of the housing.

In accordance with the present invention there is provided a simple and relatively inexpensive improvement in which a sensing tube is longitudinally adjustable radially of the casing to position a pressure sensing port therein between the intake eye of the pump and the extreme outside periphery of the casing.

In addition, the present invention affords a further advantage. The tube is received in a laterally open channel for the adjustment range provided, and this will result in a flow of water along this channel and along the tube, due to the pressure gradient from the outer periphery (the pressure side) to the intake eye (the vacuum or suction side). This flow of water of course varies with the size of the channel, as well as the pressure of water being pumped against. In any case, the flow of water past the open end of the tube, creates an additional vacuum in the tube.

In some cases this additional vacuum is useful, but in other cases it is desirable to eliminate it. Where the additional vacuum is not desired, the tube is closed at its inner end, and the pressure sensing port is provided at the side of the tube closely adjacent its closed inner end. In this case the stream of water across the sensing port creates no additional vacuum, and the pressure sensitive switch which controls the pump motor responds only to a neutral zone that automatically develops as the pump reaches the empty stage.

DETAILED DESCRIPTION

The present invention relates to an improvement in a pressure responsive control for a centrifugal pump.

The centrifugal pump is driven by an electric motor which in turn is controlled by a pressure responsive switch, all as fully disclosed in my prior U.S. Pat. No. 3,043,225, to which reference is made for a description of the operation and of details not repeated herein.

Figure 3:
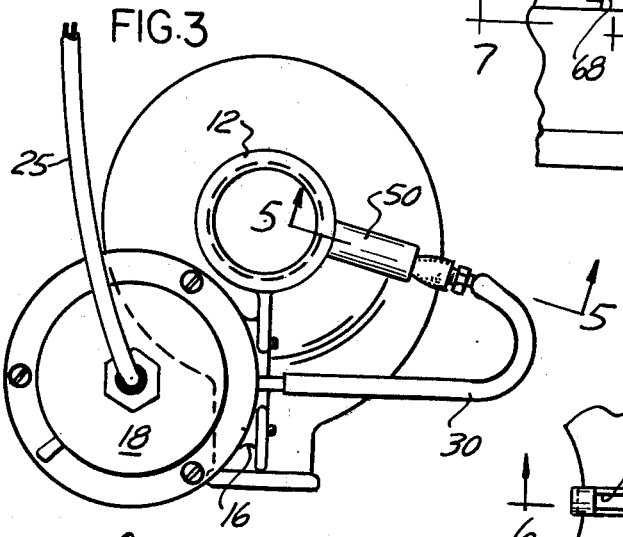
FIG. 3 is a plan view of the pump and pressure sensitive switch of the present invention.
Figure 4:
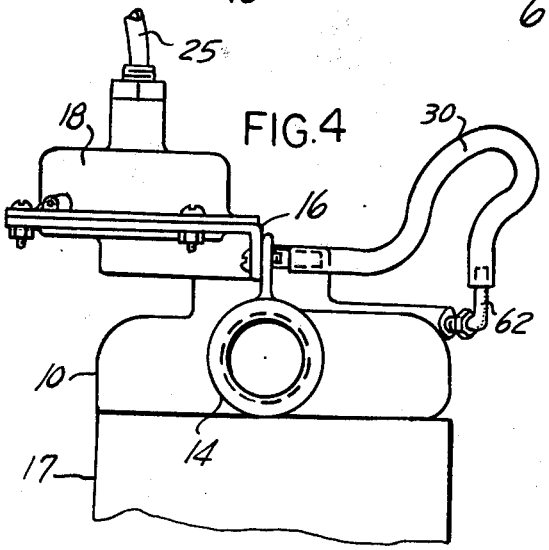
FIG. 4 is an elevational view of the system seen in FIG. 2.
Figure 5:
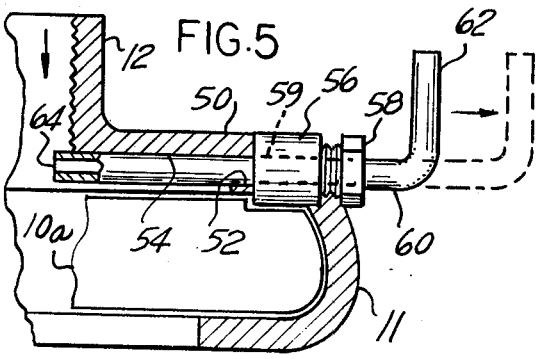
FIG. 5 is an enlarged fragmentary sectional view on line 5—5, FIG. 2.

As best seen in FIGS. 3–5, the system comprises a centrifugal pump having a casing 10 with a rotary impeller **10*a* therein, the impeller not being illustrated herein. The pump casing 10 in general has flat end (top and bottom) walls and a peripheral wall 11 of circular cross-section. The intake to the pump is through an upwardly open projection 12 in the top wall and the pump discharges through an outlet 14**.

As illustrated herein the switch controlling the motor 17 which drives the impeller is contained in a housing 18 which is mounted on bracket structures indicated generally at 16. It will be understood that normally the pump housing or casing 10 is mounted on the upper end of the electric motor, and the impeller of the pump may be coupled directly to the motor shaft.

The electric motor which drives the impeller of the pump 10 is controlled by suitable switch means mounted in the housing 18, which comprises an upper dome-shaped portion 19 and a lower support portion 20. Intermediate the housing portions 19 and 20 is a flexible diaphragm 21 which is adapted to control a pressure responsive switch 22 having a button 23 engageable by a pressure plate provided on the diaphragm 21. The electrical conductors 24 lead from the switch 22 to the motor through a conduit 25.

The space within the housing 18 below the diaphragm 21 constitutes a pressure chamber 27 which is connected through a passage 28 and fitting 29 to a flexible tube 30 having a pressure sensitive port at its inner end within the pump housing 10 as will subsequently be described.

Figure 1:
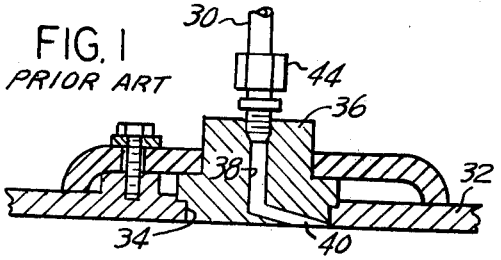
FIG. 1 PRIOR ART
FIG. 1 is a sectional view of the adjustable pressure sensing port disclosed in my prior U.S. Pat. No. 3,043,225, over which the present design is an improvement.

In my prior patent, as illustrated in prior art FIG. 1, the upper wall 32 of the pump housing has a circular opening 34 which receives a rotatable plug 36 having an axially extending passage 38 connected to a laterally extending passage providing an eccentric pressure sensing port 40. The flexible conduit 30, connected to the passage 38 by a coupling 44 in my prior construction is seen in prior art FIG. 2 as in communication with the pressure chamber 27.

In the previous construction rotation of the block 36 moves the pressure sensing port 40 through a 360° range of adjustment and in effect locates the pressure sensing port 40 at different radial positions with respect to the axis of the impeller.

As is well understood, pumps of this type in operation establish a suction at the axis or eye of the impeller, and this pressure increases to a maximum adjacent the peripheral wall of the pump housing.

Figure 8:
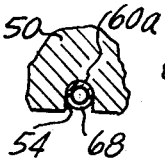
FIG. 8 is a sectional view on line 8—8, FIG. 6.

In order to provide a simple construction which affords the maximum adjustment of the location of a pressure sensing port, the construction best illustrated in FIGS. 3–5 is provided. As seen in these figures the top wall of the pump casing is provided with a longitudinally extending boss 50 through which a drilled passage 52 is provided. The lower portion of this passage is cut away, thus providing a downwardly open channel 54 as best illustrated in FIG. 8. It will be understood that the channel as illustrated in FIG. 8 is the same in both embodiments of the invention.

The upper wall of the pump housing 10 is provided with an internally threaded fitting 56 which is provided in a cut-away portion and which receives the thread shank of a tubular screw 58 having an opening 59 therethrough in alignment with the drilled passage 52 and the upper cylindrical wall of the channel 54.

Longitudinally slidable in the channel 54 and also slidable through the openings 52 and 59 is a straight tube 60 having an outer upwardly bent portion 62 which receives the flexible tube 30 as best seen in FIG. 4.

Figure 2:
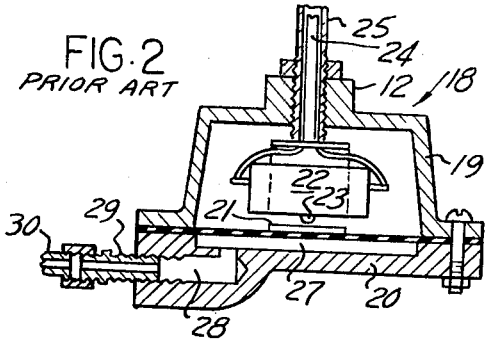
FIG. 2 PRIOR ART
FIG. 2 is a sectional view of the pressure actuated switch, which may be identical with the prior art switch disclosed in my prior patent.

In this embodiment of the inventon the tube 60 is open at its end to provide a pressure sensing port 64 and the pressure at this port is communicated through the tube 60, flexible tube 30 to the interior of the pressure chamber 27 seen in FIG. 2.

It will be observed from an inspection of FIG. 5 that the port 64 which is illustrated closely adjacent to the eye of the impeller may be adjusted to the radially outer end of the channel 54, which as seen in FIG. 5 is closely adjacent the member 56.

Moeover this adjustment, as contrasted to the rotary adjustment of the plug 36 in the prior art construction illustrated in FIG. 1, is linear so that the adjustment of the port corresponds precisely to the longitudinal adjustment of the tube. In the prior art construction the rotation of the eccentric plug provides maximum adjustment of the sensing port per unit of rotation when the port is midway between its extreme inner and outer position. Similarly it provides minimum adjustment per unit of rotation when the eccentric port is at its extreme inner or outer position. Moreover by observing the location of the outer end 62 of the tube 60, there is provided a direct indication of the location of the pressure sensing port.

Figure 6:
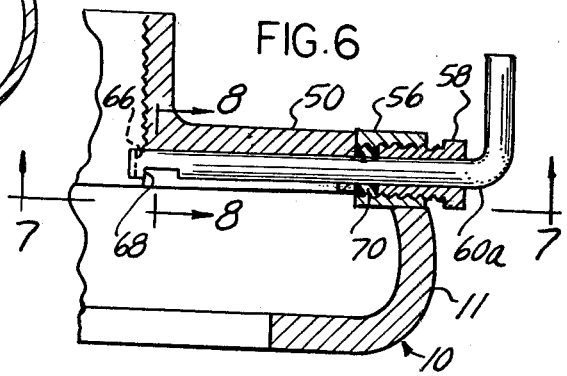
FIG. 6 is a sectional view similar to FIG. 5 showing a modification of the present invention.
Figure 7:
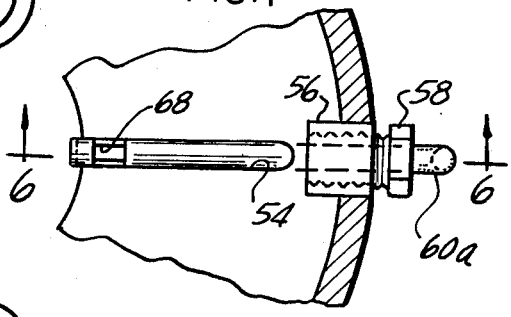
FIG. 7 is a sectional view on line 7—7, FIG. 6.

With the construction illusrated in FIG. 5, it will be appreciated that there is a continual flow of water in the channel 54 along the tube 60 and this flow as it passes the port 64 at the inner end of the tube, induces a reduction of the pressure of the pump fluid as sensed by the pressure sensitive switch. In some installations this may be a desirable feature but in other cases it is undesirable.

Where it is desired to eliminate this reduction in pressure (increase in vacuum or suction) as sensed at or adjacent the inner end of the tube, the construction illustrated in FIGS. 6–8 is provided. In this construction the inner end of the tube, here designated **60*a*, is closed as indicated at 66 and a pressure sensing port 68 is provided by cutting away the lower portion of the tube 60*a* closely adjacent its inner end. With this construction the flow of water along the channel 54 and along the inner end of the tube 60*a* is across the port 68** and accordingly does not induce a variation in the pressure or suction sensed thereat.

It will be understood that the inner end of the tubular screw 58 engages compressible packing means 70 which will provide an effective seal and at the same time clamp the tube 60 or **60*a*** in adjusted position.

Figure 9:
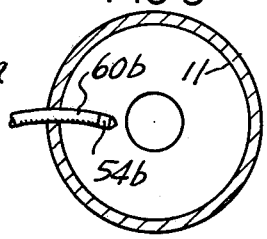
FIG. 9 is a diagrammatic sectional view of another embodiment.

While the simple construction in one in which the tube 60 is a straight rigid metal tube, it is of course possible to use the arcuately curved tube **60*b* as shown in FIG. 9. This tube may be rigid, and slidable longitudinally in arcuately curved channel 54*b*. Also, since tube 60*b* is guided in channel 54*b***, the tube may have limited flexibility.

I claim:

1. An impeller pump and conrol system comprising an impeller-type pump having a housing of circular cross-section for receiving a rotary motor driven impeller, said housing having a central liquid intake opening and a peripheral outlet opening in which while the pump is in operation there is a pressure gradient from a suction condition at the central intake opening to a pressure condition at the peripheral outlet opening of the housing, a pressure responsive switch for controlling the pump motor, and means for commumicating pressure as sensed within said housing at different radially selected points along the pressure gradient to said pressure responsive switch comprising a tube having a pressure sensing port adjacent its inner end, said housing having a generally radially facing opening in its peripheral wall in which said tube is longitudinally slidable radially of said housing to position its pressure sensing port at a selected location with reference to said pressure gradient, and conduit means connecting the outer end of said tube to said pressure sensitive switch whereby longitudinal adjustment of said tube produces a corresponding linear adjustment of its pressure sensing port along the pressure gradient existing within said housing between its central inlet and its peripheral outlet.

2. A system as defined in claim 1, comprising a channel at the inside of an end wall of said housing communicating at its outer end with the opening in said housing wall, said tube being slidably received in said channel with one side exposed to liquid within said housing.

3. A system as defined in claim 2, said tube having an open inner end which provides said port.

4. A system as defined in claim 2, said tube having its inner end closed, said port being located in a side of said tube adjacent its inner end.

5. A system as defined in claim 1, in which said tube is a straight rigid tube.

6. An impeller pump for use in a system including an electric motor for driving the pump, and a pressure responsive switch connected to sense a pressure condition within the pump connected to control the motor, said pump comprising a flat housing of circular cross-section, an impeller rotatable within said housing about a central transverse vertical axis, a pump inlet in said casing located centrally of an end wall thereof, a pump outlet in the outer peripheral wall of said housing, the peripheral wall of said housing having a radial opening therein, and a straight elongated pressure sensing tube longitudinally slidable in said opening generally radially of said housing, and a pressure sensing port adjacent the inner end of said tube, said pressure sensing port of said tube being radially movable within said housing to sense pressure within said housing at selected points between the central pump inlet and the peripheral pump outlet, whereby longitudinal adjustment of said tube produces a corresponding linear adjustment of its pressure sensing port along the pressure gradient existing within said housing between its central inlet and its peripheral outlet.

7. A pump as defined in claim 6, in which the inner end of said tube is open to constitute said pressure-sensitive port.

8. A pump as defined in claim 7, in which one end wall of said housing has an elongated channel extending radially of said housing in alignment with said opening in its peripheral wall in which said tube is slidably received.

9. A pump as defined in claim 8, the inner end of said tube being closed and said pressure-sensitive port being located at the side of said tube exposed in said channel adjacent the inner end of said tube.

10. A pump as defined in claim 6, said housing having an externally projecting radially extending rib at one flat end thereof, a radially bored opening extending within said rib and the adjacent end wall of said housing, the inner wall portion of said housing in registration with said bored opening being cut away to provide an open sided channel extending from adjacent the peripheral wall of said housing to its central portion adjacent said inlet, said tube being longitudinally slidable radially of said opening and along said channel.

11. A pump as defined in claim 10, said tube having its inner end open to provide said pressure-sensing port.

12. A pump as defined in claim 10, said tube having its inner end closed and a pressure sensing port in its side adjacent the inner end thereof exposed in said channel to the liquid being pump.

13. A pump as defined in claim 6, said housing having a cut-out portion adjacent the outer end of said bored opening, an internally threaded first fitting secured at the cut-out portion in alignment with said bored opening, and an externally threaded tubular fitting threaded in said first fitting and receiving said tube.

14. A pump as defined in claim 6, in which one end wall of said housing has an elongated inner channel extending generally radially of said housing in alignment with said opening in its peripheral wall in which said tube is received, the inner end of said tube being closed and said pressure-sensitive port being located at the side of said tube exposed in said channel adjacent the inner end of said tube.

* * * * *